United States Patent [19]

Hill

[11] 4,300,260

[45] Nov. 17, 1981

[54] MAGNETIC PICK UP ATTACHMENT FOR VACUUM CLEANERS

[76] Inventor: Claudette D. Hill, 1923 Pembridge Pl., Detroit, Mich. 48207

[21] Appl. No.: 97,575

[22] Filed: Nov. 26, 1979

[51] Int. Cl.[3] ..... A47L 9/00

[52] U.S. Cl. ..... 15/339; 209/215; 428/40

[58] Field of Search ..... 15/339; 209/215; 428/40

[56] References Cited

U.S. PATENT DOCUMENTS

| | | | |
|---|---|---|---|
| 2,847,084 | 8/1958 | Wolfskill et al. | 15/339 X |
| 3,206,783 | 9/1965 | Schwartz | 15/10 S |
| 4,006,512 | 2/1977 | Saulson | 15/339 |
| 4,162,672 | 7/1979 | Yazaki | 428/40 X |

*Primary Examiner*—Chris K. Moore

*Attorney, Agent, or Firm*—Cullen, Sloman, Cantor, Grauer, Scott & Rutherford

[57] ABSTRACT

A magnetic pick up attachment for vacuum cleaners includes an elongated strip of magnetized material adapted to overlie, connect to and depend from the front face of a vacuum cleaner housing.

11 Claims, 10 Drawing Figures

MAGNETIC PICK UP ATTACHMENT FOR VACUUM CLEANERS

BACKGROUND OF THE INVENTION

Heretofore in the operation of vacuum cleaners such as in homes and in offices, present vacuum cleaners available on the market are not readily effective for picking up objects as pins, staples, paper clips, hairpins or other metallic objects which tend to collect upon the floor. Such metallic items including nails often are embedded down into the nap of the carpet on the floor surface and in many situations are not subjected to the conventional suction of the vacuum cleaner.

SUMMARY OF THE INVENTION

The primary purpose of the present invention is to provide a magnet upon the front face of a vacuum cleaner and depending therefrom so as to be closely adjacent a carpeted floor surface.

It is another object to provide a magnetic pick up attachment for vacuum cleaners comprising an elongated strip of magnetized material, preferably flexible, which is adapted to overlie, connect to and depend from the front face of a vacuum cleaner housing.

It is another object to provide the magnetic pick up attachment for vacuum cleaners which is made from a strip of material selected from a group which consists of plastic, rubber, Neoprene, fibre and ferrous metal. It is considered equivalent any form of magnetizing the strip such as including a dispersion of ferrous magnetized particles therethrough.

It is a further object to provide a magnetic pick up attachment for vacuum cleaners in the form of a magnetized flexible strip of material which has adjacent and along its lower edge, a series of longitudinally spaced dust apertures to permit the passage of air therethrough.

It is a further objective to provide various means by which the magnetic strip may be secured or adhered to the front face of a vacuum cleaner housing. These include the use of fasteners, pressure sensitive adhesive or Velcro strips.

The present invention includes the packaging of the present magnetized strip, marketed as an attachment for vacuum cleaners and which will have upon its rear surface, a layer of pressure sensitive adhesive covered by a protective tear off strip, which product may be sold in supermarkets and the like for easy attachment to the front and/or side faces of a vacuum cleaner.

The present invention also includes in combination with a vacuum cleaner having a housing on the front face thereof of a magnetic strip secured thereto and having a depending apertured lower edge portion thereof, closely adjacent to carpeted floor surface over which the conventional vacuum cleaner moves.

The invention is directed to various types of vacuum housings adapted to move over a carpet or a floor, such as the canister type or to electric brooms.

These and other objects will be seen in the following specification and claims in conjunction with the appended drawing.

THE DRAWING

It will be understood that the above drawing illustrates merely a preferred embodiment of the invention, and that other embodiments are contemplated within the scope of the claims present forth.

DETAILED DESCRIPTION OF THE INVENTION

Figure 1:
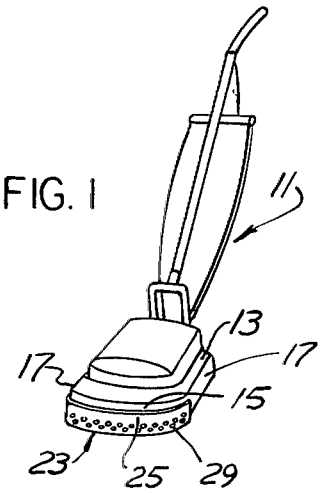
FIG. 1 is a front perspective view of a conventional vacuum cleaner to which the present magnetic pick up attachment has been secured.
Figure 7:
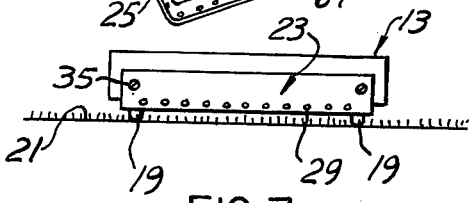
FIG. 7 is a schematic front elevational view showing a portion of a vacuum cleaner housing as applied to a carpeted surface with the magnetized strip attached thereto.

Referring to the drawing, FIG. 1 is a perspective view of a conventional vacuum cleaner 11 which has a housing 13 with front face 15 and side walls 17 and the usual rollers 19 shown in FIG. 7 adopted for supporting registry with a carpeted floor 21.

In accordance with the present invention, a magnet generally indicated at 23 is applied to the front face of the vacuum cleaner housing and suitably secured thereto.

The magnetic pick up attachment comprises a magnet 23 consisting of an elongated strip 25 of magnetizable material generally of rectangular shape, flexible in character and constructed of plastic, such as polyethylene, rubber, fibre, Neoprene or any other ferrous material. The strip has been suitably magnetized in a conventional manner and said magnetized strip may include without excluding other possibilities, a dispersion of magnetized ferrous particles within the strip.

Figure 3:
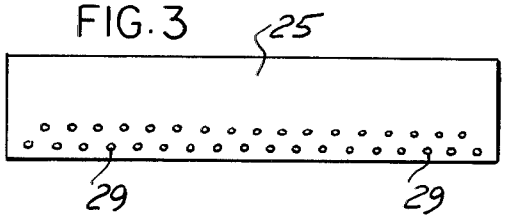
FIG. 3 is a front elevational view of the present magnetized strip of material.

The present strip of magnetizable material therefore can be made of various materials, preferably flexible so as to conform to the front face 15 of the vacuum cleaner housing and secured thereto in various ways. A layer of pressure sensitive adhesive 27 is applied to the back of said strip, FIGS. 3, 5 and 6. Formed across the lower edge of the strip 25 are a series of longitudinally spaced dust apertures 29 in one or more longitudinal rows, and suitably staggered. These provide for the passage of air therethrough with the strip nevertheless serving as a magnet and adapted for the picking up of metallic objects which collect upon a carpeted surface or floor such as pins, staples, paper clips, metal pieces, nails, hairpins or the like.

Figure 4:
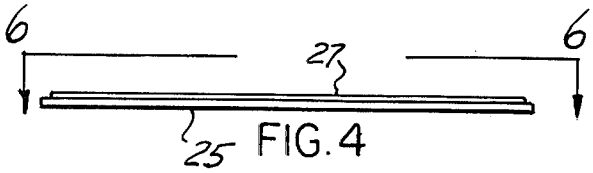
FIG. 4 is a plan view thereof.
Figure 5:
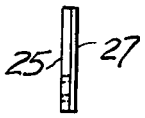
FIG. 5 is an end elevational view thereof.
Figure 6:
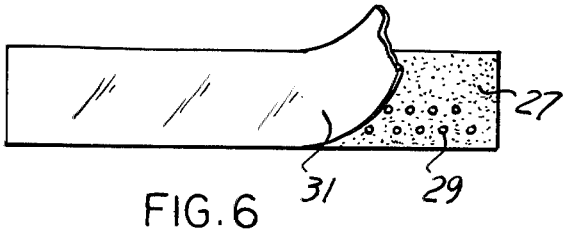
FIG. 6 is a rear elevational view of the strip shown in FIG. 3, taken in the direction of arrow 6—6 of FIG. 4, and with a protective tear off strip fragmentarily shown overlying the adhesive surface upon said strip.

Various means may be employed for securing the elongated flexible magnetic strip to the vacuum cleaner housing. In FIGS. 4, 5 and 6, a pressure sensitive layer 27 is employed on the strip for direct adherence to the front face of the vacuum cleaner. Normally, a removable protective tear off strip 31, FIG. 6, is applied to the product.

Figure 2:
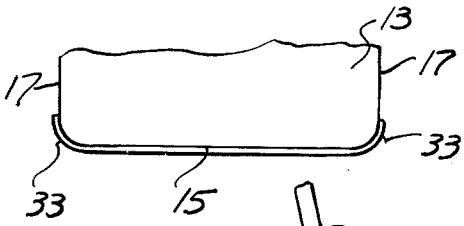
FIG. 2 is a fragmentary plan view of a portion of the housing of a vacuum cleaner to which the present magnetized strip of material has been attached, shown on an increased scale with respect to FIG. 1.

Since the material of the strip 25 is flexible, the ends thereof may be rearwardly curved as at 33 of FIG. 2 so as to cooperate with portions of the adjacent side walls 17 of the vacuum cleaner housing 13.

As shown in FIG. 7, which is a schematic front elevational view of the present magnetic strip as mounted upon the forward face of the housing, the strip is so located with respect to said forward face that its lower longitudinal edge is closely adjacent the carpeting 21 or other flooring over which the vacuum cleaner moves. In one embodiment a pair of sheet metal screw fasteners 35 extend through end portions of strip 25 and into corresponding apertures within the housing front wall 15.

Figure 8:
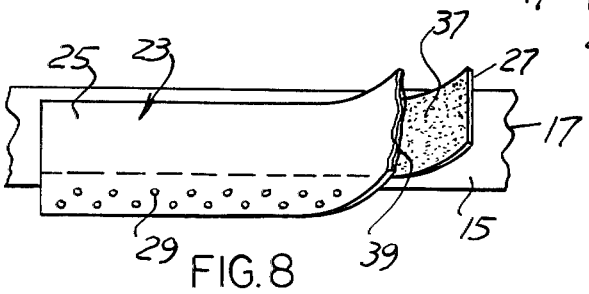
FIG. 8 is a fragmentary front elevational view of the front face of a vacuum cleaner housing to which a modified form of magnetized strip is mounted, employing Velcro strips upon the front face of the vacuum cleaner housing and upon the rear surface of the magnetized strip.

An alternate method of anchoring the magnetized strip upon the front face of the vacuum cleaner housing is shown schematically in FIG. 8. Here an elongated Velcro strip 37 having a pressure sensitive adhesive rear surface 27 is first applied to the front surface of the vacuum cleaner housing. Thereafter, the present magnetized strip 25, has applied thereto on its rear surface, a Velcro strip 39 adjustably positioned over the first Velcro strip 37 and retained thereon. The lower longitudinal edge of said strip is closely adjacent the carpet surface 21 in the same manner as shown in FIG. 7.

Figure 9:
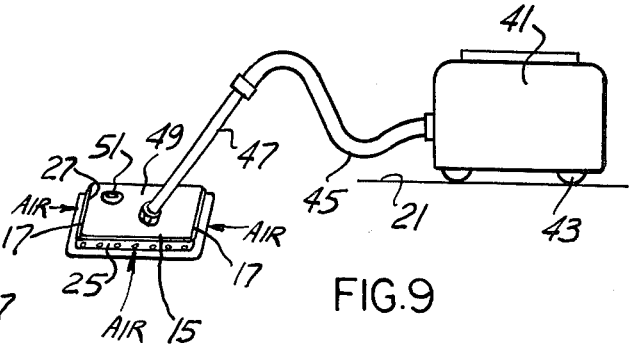
FIG. 9 is a schematic view of a canister type of vacuum cleaner with the magnetic strip applied to the head.

A modification of the invention is shown in FIG. 9 wherein there is schematically illustrated a canister type of vacuum cleaner 41 having wheels 43 movably positioned over the carpeted surface 21. A flexible hose 45 connects a wand 47 which at its lower end is affixed to the horizontally disposed vacuum head 49. Said head has a front wall 15 and adjacent rearwardly extending side walls 17. The present flexible magnetized strip 25 is applied to the front face of the head 49 and end portions of the strip are folded rearwardly so as to overlie and adhere to the side walls of the head. The pressure sensitive strip 27 upon the rear of the magnetized strip provides a means for anchoring the magnetized strip to the front and side portions of the head 49. Any of the other forms of attachment may be employed.

Said head includes a conventional control 51 by which air can enter the head selectively either at the front alone or also at the sides as shown by the arrows. Accordingly, the row or rows of longitudinally spaced dust apertures 27 are arranged upon the front as well as the sides of the head to permit the passage of air therethrough. At the same time said strip is capable of picking up metallic items such as paper clips, staples, etc.

Figure 10:
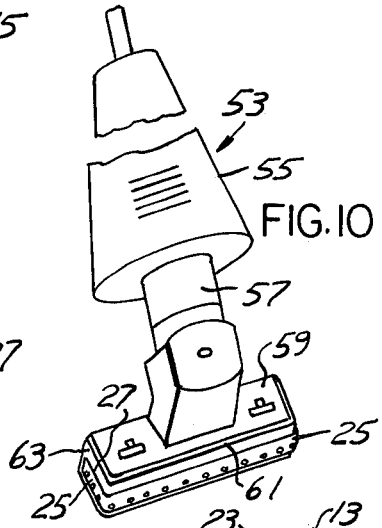
FIG. 10 is a similar view of an electric broom with the magnetic strip applied thereto.

An air broom is schematically shown at 53, FIG. 10. The vacuum housing 55 is connected to a depending pipe 57 connected to suction head 59 with front wall 61 and side walls 63. The present magnetic strip 25 is suitably secured over said walls or by an adhesive backing 27, FIG. 6, or any other securing means.

Having described my invention, reference should now be had to the following claims.

I claim:

1. A magnetic pick up attachment for vacuum cleaners comrising an elongated strip of magnetized material adapted to overlie, connect to and depend from the front face of a vacuum cleaner housing, therebeing a row of laterally spaced dust apertures extending through said strip adjacent and along the lower longitudinal edge thereof and below said front face for the passage of air and dust therethrough, for entry into the nozzle of the vacuum cleaner.

2. A magnetic pick up attachment for vacuum cleaners comprising an elongated strip of magnetized material adapted to overlie, connect to and depend from the front face of a vacuum cleaner housing, said strip being flexible, and of rectangular shape, and having a lower longitudinal edge parallel to and adapted for spacing above and adjacent a carpeted floor;

said material being selected from the group consisting of plastic, rubber, Neoprene, fibre and ferrous metal;

therebeing a row of laterally spaced dust apertures extending through said strip adjacent and along the lower longitudinal edge thereof and below said front face for the passage of air and dust therethrough, for entry into the nozzle of the vacuum cleaner;

and a means for securing said strip to said housing.

3. In the magnetic pick up attachment of claim 2, said securing means being a pressure sensitive adhesive.

4. In combination with a vacuum cleaner having an upright front wall terminating in side walls;

a magnetic pick up attachment comprising an elongated flexible strip of magnetized material overlying said front face and depending therefrom, and means securing said strip to said front face;

therebeing a row of longitudinally spaced dust apertures extending through the lower edge portion of said strip below said front face, for the passage of air and dust therethrough, for entry into the nozzle of the vacuum cleaner.

5. In the magnetic pick up attachment of claim 4, said attaching means including a layer of pressure sensitive adhesive upon one side of the strip.

6. In the magnetic pick up attachment of claim 4, said attachment means including a strip of Velcro adhered to said front face, and a cooperating strip of Velcro adhered to one surface of said strip.

7. In the magnetic pick up attachment of claim 4, end portions of said strip being curved rearwardly engaging the housing side walls.

8. In the magnetic pick up attachment of claim 4, said vacuum cleaner being of the type including a canister and a head with interconnecting hose, said head being manually movable over the floor surface and;

said front face and side walls being the corresponding walls of said head;

said strip of magnetized material being mounted on and secured to said head and depending from its front and side walls.

9. In the magnetic pick up attachment of claim 4, said vacuum cleaner being an electric broom having a head manually movable over a floor surface;

said front face and side walls being the corresponding walls of said head;

said strip of magnetized material being mounted on and secured to said head and depending from its front and side walls

10. In the pick up attachment of claim 1, a layer of Velcro mounted over and adhered to one surface of said strip;

and a cooperating strip of Velcro adhered to said front face.

11. In the pick up attachment of claim 1, there being a pair of spaced apertures adjacent opposite ends of said strip adapted to receive fasteners to engage said vacuum cleaner housing.

* * * * *